United States Patent [19]

Normand

[11] Patent Number: 4,965,901

[45] Date of Patent: Oct. 30, 1990

[54] FUTON WITH INFLATABLE CORE

[76] Inventor: Gaudry Normand, 6515 Place Monette, Charlesbourg, Quebec, Canada, G1H 6M7

[21] Appl. No.: 395,993

[22] Filed: Aug. 21, 1989

[51] Int. Cl.[5] ..... A47C 27/00

[52] U.S. Cl. ..... 5/465; 5/455; 5/470

[58] Field of Search ..... 5/449, 455, 457, 465, 5/470, 453, 12 R; 297/456, 229

[56] References Cited

U.S. PATENT DOCUMENTS

| | | | |
|---|---|---|---|
| 16,555 | 2/1857 | Simonds | 5/455 |
| 1,892,679 | 1/1933 | Penner | 5/465 |
| 1,970,803 | 8/1934 | Johnson | 5/455 |
| 2,000,873 | 5/1935 | Arens | 5/453 |
| 2,069,422 | 2/1937 | Sampson | 5/449 |
| 2,623,574 | 12/1952 | Damsch | 5/455 |
| 2,691,179 | 10/1954 | Kann | 5/455 |
| 2,731,652 | 6/1956 | Bishop | 5/457 |
| 2,942,281 | 6/1960 | Cole | 5/441 |
| 3,420,574 | 1/1969 | Smith | 5/449 |
| 3,761,131 | 9/1973 | Oliver | 297/456 |

FOREIGN PATENT DOCUMENTS

| | | | |
|---|---|---|---|
| 732517 | 4/1966 | Canada | 5/555 |
| 805434 | 7/1949 | Fed. Rep. of Germany | 5/455 |
| 61859 | 7/1951 | France | 5/455 |
| 1422306 | 11/1965 | France | 5/455 |
| 2226949 | 11/1974 | France | 5/455 |
| 1286299 | 8/1972 | United Kingdom | 5/470 |

*Primary Examiner*—Gary L. Smith
*Assistant Examiner*—F. Saether
*Attorney, Agent, or Firm*—Lahive & Cockfield

[57] ABSTRACT

A futon has flexible, foldable, separately tufted covering layers zippered to enclose a pair of pneumatic layers. The pneumatic layers are separately inflatable, coplanar, and foldable along one set of parallel axes, and also foldable at a perpendicular axis along the line between the pneumatic layers.

5 Claims, 5 Drawing Sheets

FUTON WITH INFLATABLE CORE

BACKGROUND OF THE INVENTION

This invention relates to futons, and particularly to futons with inflatable cores.

Futons have become increasingly popular in recent years as multi-purpose furniture for apartments. The advantages of a futon is that it is large, flexible and cushionlike. It is large enough to be used as a sofa or a bed. It is flexible enough to be foldable, so that it may be stored and transported easily, but it is also firm enough so that it may be used with different furniture frames to form a sofa or a bed. Indeed, one of the most popular uses of futons is as an element of sofa-bed frames that can be converted between sofa and bed frame configurations. In the sofa configuration, the futon is firm enough to be propped up as the seat and back cushions. In the bed configuration, the futon is flexible enough to be a comfortable mattress.

One of the elements that contributes to the futon's utility is that futons are generally tufted. That is, they are made firm by stitching at intervals and sewing on tufts. The tufted effect and appearance is associated with the utility of futons.

The invention that is the subject of this application is concerned with an inflatable core for futons that does not detract from the futon's utility and appearance.

The prior art shows mattresses and cushions with inflatable interior elements, but these have as their goal a rigid, not foldable, cushioning device. See, for example, U.S. Pat. Nos. 1,970,803; 2,000,873; 2,691,179 and 2,942,281. Two of the patents (U.S. Pat. Nos. 1,970,803 and 2,000,873) show such mattresses with a tufted appearance obtained by providing sealed passages through the inflatable interior elements for tufting thread. The mattresses shown in these two patents would be difficult to manufacture, because of the need to align tufting with the interior thread passages. The inflatable interior elements of these mattresses are also integral parts of the final product, making them difficult to disassemble for repair.

It is an object of the invention to provide a futon with an inflatable core that retains the utility and appearance of a conventional futon, and that is simple to manufacture, assemble and repair.

SUMMARY OF THE INVENTION

The invention comprises a flexible, foldable, futon having opposing flexible, foldable, covering layers, at least one of which includes a casing containing solid cushioning material, and an inflatable, flexible, foldable, pneumatic cushioning layer comprising an inflatable casing, the casing being arranged to be foldable along one or more parallel axes when the pneumatic layer is inflated, the pneumatic layer being captured between the opposing covering layers. In preferred embodiments, at least one of the covering layers is separately tufted, and there is a second pneumatic layer co-planar with the first, the futon being thereby foldable along a second axis perpendicular to the first parallel axes. Also, the covering layers may have edges bearing closing means for closing the covering layers around the pneumatic layer, and the pneumatic layer has extending edges defining openings and means for securing the pneumatic layer to at least one of the covering layers, the securing means extending through the openings. Furthermore, the pneumatic layer may include means for inflating the layer to different degrees of inflation, and if there are two layers, they may be independently inflatable.

BRIEF DESCRIPTION OF THE DRAWINGS

Other objects, features and advantages of the invention will be described or be apparent from the following description of a preferred embodiment thereof, including the drawings, which include the following figures.

DESCRIPTION OF A PREFERRED EMBODIMENT

Figure 1:
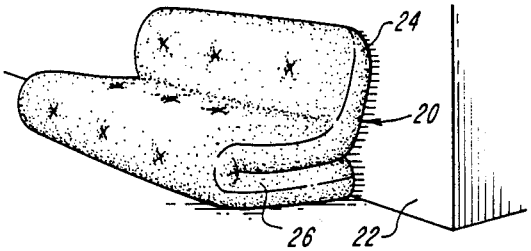
FIG. 1 shows a futon constructed according to the invention, arranged in an "S" shape and propped against a wall.
Figure 2:
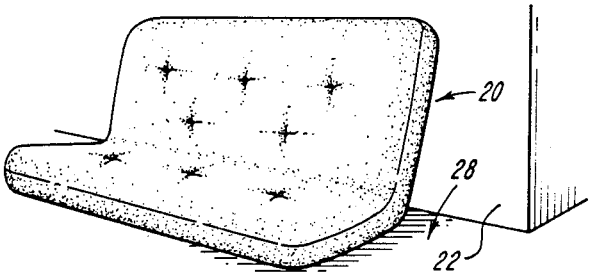
FIG. 2 shows a futon constructed according to the invention, used as a sofa in an "L" shape propped against a wall.
Figure 3:
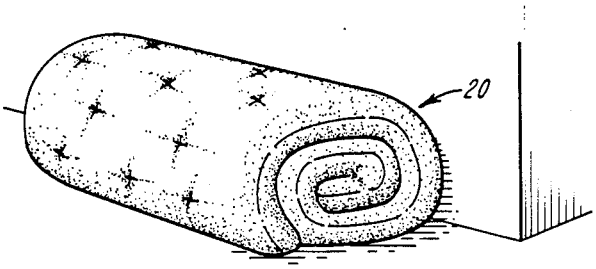
FIG. 3 shows a futon constructed according to the invention, rolled to form a cushioned seat.

FIGS. 1, 2 and 3 shows variouS configurations of the futon 20 of the invention. FIG. 1 shows the futon 20 in an "S" shape propped against a wall 22. Here the wall 22 allows a vertical portion 24 of the futon 20 to act as a vertical back support and the double thickness 26 of the lower horizontal portions of the folded futon 20 act as a comfortable seat cushion. In FIG. 2 the wall 22 and floor 28 provide a support against which the "L" shaped futon 20 rests, making a form of sofa from the futon 20 alone. FIG. 3 shows the futon 20 rolled to provide a simple seating cushion.

Figure 4:
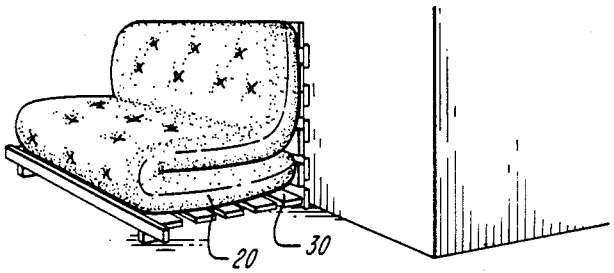
FIG. 4 shows a futon constructed according to the invention, in an "S" shape like that shown in FIG. 1, but used in combination with a frame.
Figure 5:
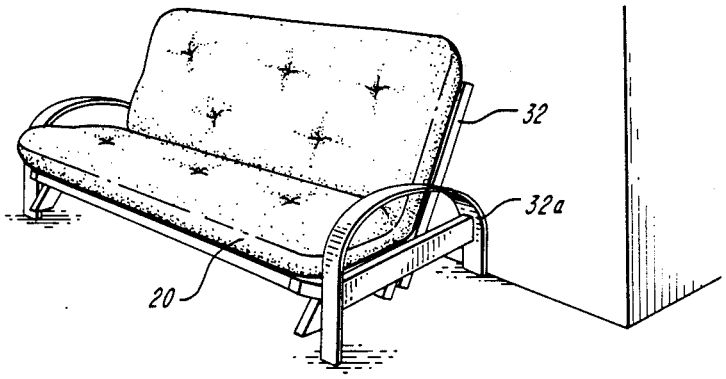
FIG. 5 shows a futon arranged like that shown in FIG. 2, but on a sofa frame.

FIG. 4 shows a futon 20 formed like the one in FIG. 1, namely in an "S" shape, but with a frame 30 to support the futon 20. FIG. 5 shows a more elaborate frame 32, with arms 32*a*,, which can convert from a sofa to a bed and vice versa. The futon 20 is shown propped up in an "L" shape on the frame 32 in the sofa position.

Figure 6:
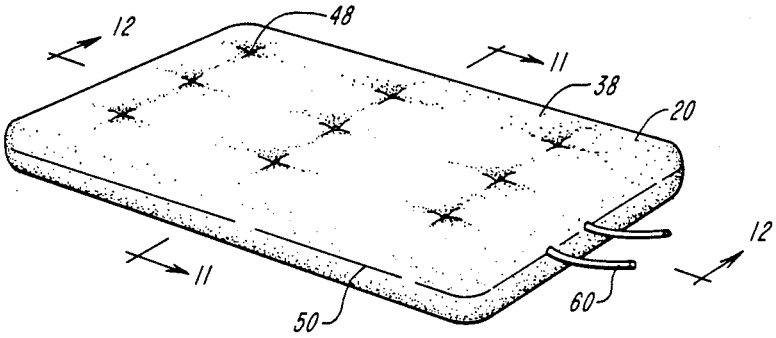
FIG. 6 shows the futon constructed according to the invention in a planar, mattress form.
Figure 7:
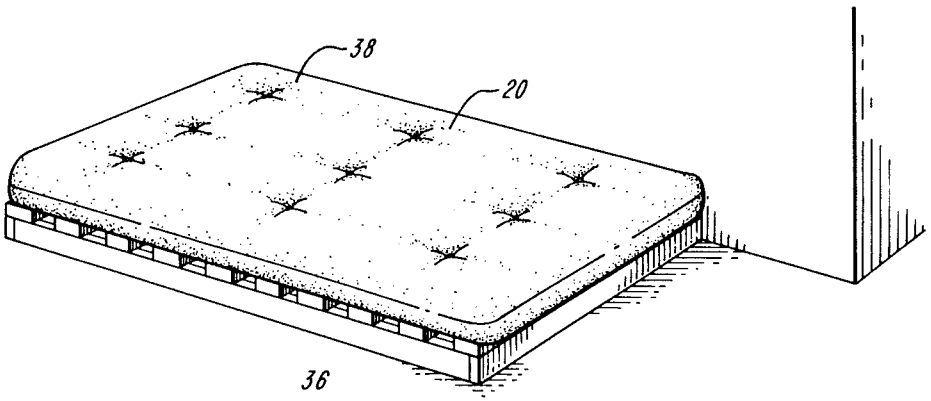
FIG. 7 shows the futon in the configuration of FIG. 6 on a bed frame.

FIG. 6 shows a futon 20 fully laid out, as for use as a mattress. FIG. 7 shows the futon 20 in a similar configuration but on a bed frame 36 supporting the futon 20.

Figure 8:
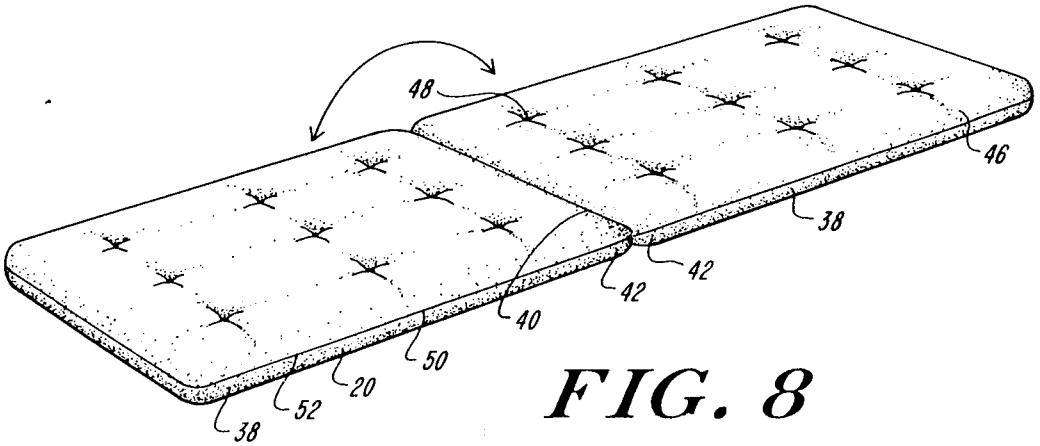
FIG. 8 shows the futon opened up showing the flexible, foldable, covering layers of the futon.

The construction of the futon 20 of the invention can be seen from FIGS. 8–13. FIG. 8 shows the covering layers 38 of the futon 20. Each layer 38 is the length and width of a conventional large futon which can be used as a mattress for two people. The covering layers 38 are joined by a seam 40 at a pair of the neighboring edges 42 of the layers 38.

Each covering layer 38 includes a solid cushioning material such as cotton batting 44 inside a casing 46. Each layer 38 is separately tufted to create a number of tufts 48 (see FIG. 13), including a tufting thread 50 joining the tufts 48, or buttons, on either side of the covering layer 38. Each covering layer 38 is flexible and foldable, like conventional futons, although the covering layer 38 is thinner than the conventional futon.

Besides cotton batting 44, the interior of each covering layer 38 could include wool batting or foam, as in conventional futons. The covering layers 38 need not be identical. One could be tufted, for example, and the other treated differently, but preferably they are identical so that the futon 20 is reversible.

The casings 46 for the covering layers 38 along the edges 50 not joined by the seam 40 have zippers 52 so that the futon 20 may be zipped closed. Other means of fastening the covering layers 38 may be used, but a zipper 52 is preferred because of its convenience.

Figure 9:
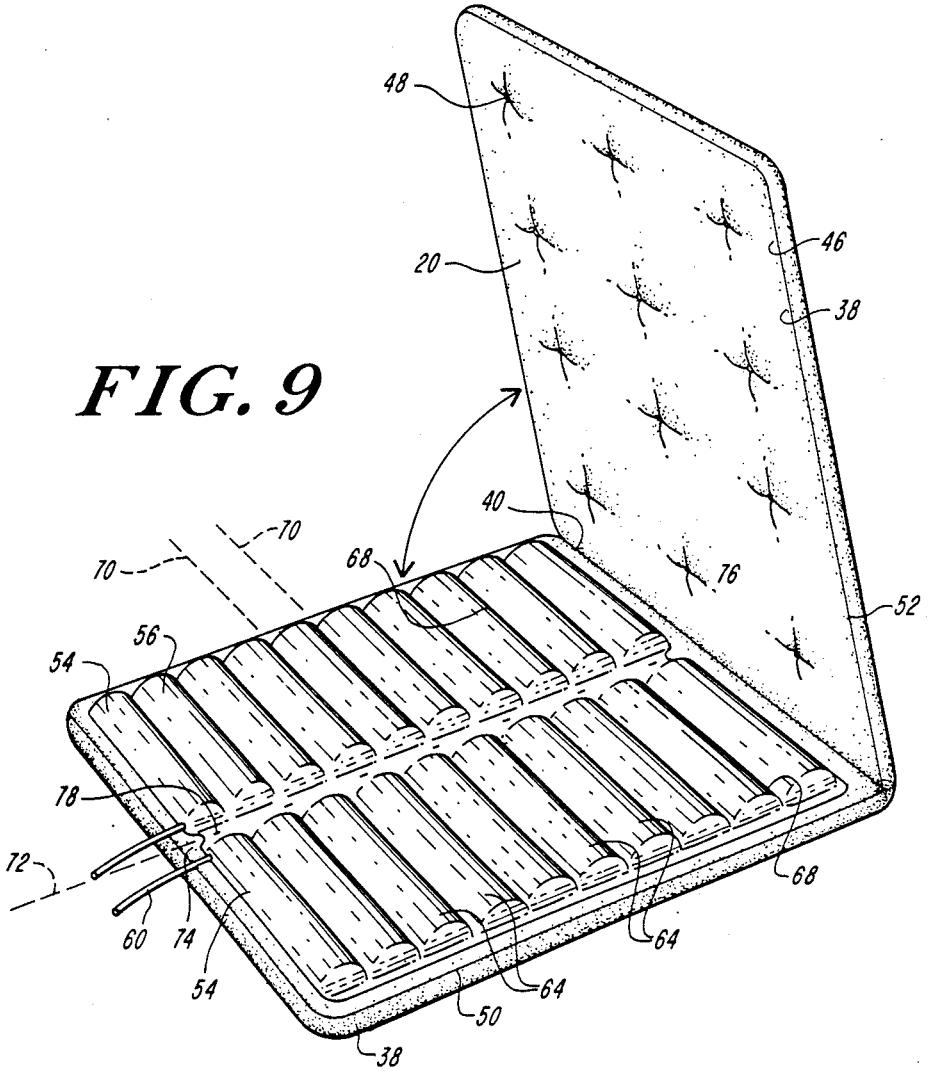
FIG. 9 shows a pair of pneumatic cushioning layers positioned between the covering layers.

As shown in FIG. 9, a pair of inflatable, flexible, foldable, pneumatic cushioning layers 54 are located between the covering layers 38. Each cushioning layer 54 consists of a casing 56 of air impermeable material (such as rubber or flexible plastic) defining an interior space 58 inflatable through a valved air inlet tube 60 by, for example, an air compressor 62 (see FIGS. 11 and 12).

Each of the pair of pneumatic layers 54 is constructed of a series of parallel tubular portions 64. The tubular portions 64 are formed by the opposite walls 66 of the casing 56, in a conventional manner, periodically being brought together, or pinched, to effectively form a series of parallel hinges 68, about which the layer 54 may be bent or folded. As a result, the futon 20 may be bent or folded along a series of parallel axes 70 generally corresponding to the hinge portions 68 of the pneumatic layers 54.

This will allow, for example, the futon 20 to be folded to assume the "S" shapes and rolled shape shown in FIGS. 1, 3 and 4.

The futon 20 can be bent or folded also on an axis 72 perpendicular to the axes 70, namely, along the line 74 between the two co-planar pneumatic layers 54. This will allow, for example, the futon 20 to be folded to assume the "L" shapes in FIGS. 2 and 5. In short, a large futon 20 with an inflatable core is created that is flexible and foldable along perpendicular axes, to assume the folded shapes typically associated with futons. A narrow futon (such as one convertible to a twin bed mattress) might have only a single pneumatic layer 54, and be foldable only into the shapes of FIGS. 1, 3 and 4. Because of its narrow width, it could be converted into a chair instead of a sofa.

The height of the futon 20 of the preferred embodiment is about 8 inches when the pneumatic layers 54 are fully inflated. About 4 inches in height is contributed by the pneumatic layers 54. Each covering layer 38 is approximately 1% to 2 inches high.

The pneumatic layers 54 can be inflated to different degrees, to provide, for example, different degrees of firmness for futon seat or back portions (in the sofa configuration) or for two sides of a mattress (in the bed configuration).

The pneumatic layers 54 also have extending edges 76 with holes 78, through which extend threads 80 for securing the pneumatic layer 54 to a covering layer 38.

Figure 10:
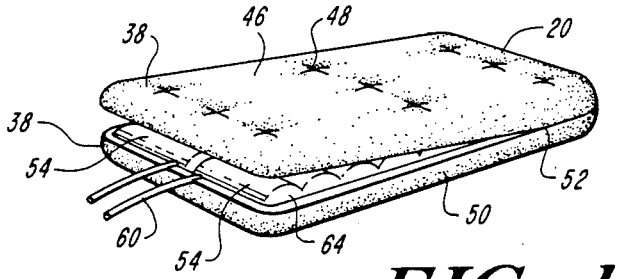
FIG. 10 shows the covering layers folded over the pneumatic layers.
Figure 11:
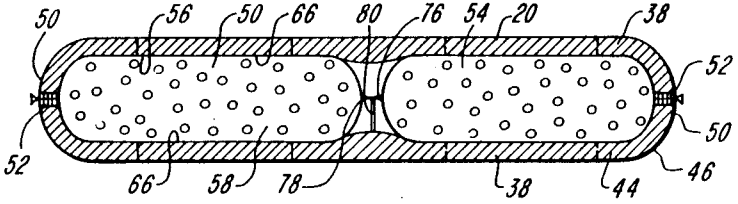
FIG. 11 is a cross-sectional view of the futon of FIG. 6, along the lines 11—11.
Figure 12:
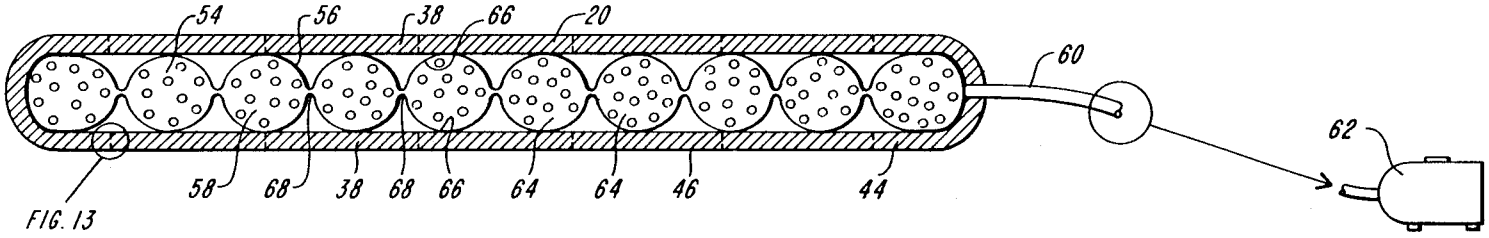
FIG. 12 is a cross-sectional view of the futon of FIG. 6 along the lines 12—12.
Figure 13:
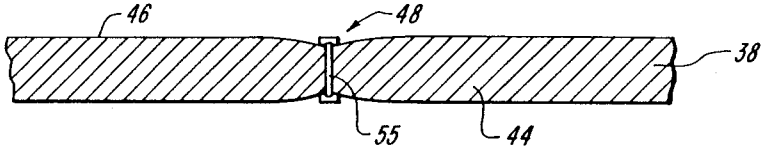
FIG. 13 is a detailed cross-sectional view of a covering layer of the futon, showing how it is tufted.

In use, the pneumatic layers 54 are captured between the covering layers 38 by the zipper 52 at the edge 50 of the covering layers 38 (see FIG. 10). The tubes 60 for input of air into the pneumatic layers 54 can either extend out of the zippered enclosures so that they may be inflated easily or, if desirable, the tubes 60 can be tucked inside the covering layers 38 before they are closed. Different degrees of inflation will provide different degrees of firmness to the pneumatic layers 54 and consequently to the futon. When the pneumatic layer 54 is completely empty, maximum compactness and portability of the futon 20 will be achieved. Subsequent inflation of the pneumatic layers 54 will add firmness and thickness to the futon 20. Even when fully inflated, however, the futon 20 may be bent and folded in the usual way.

Other variations besides those mentioned may occur to those familiar with the futon industry, and the preferred embodiment is meant only to be exemplary of the invention which is covered by the following claims.

I claim:

1. A flexible, foldable futon comprising opposing flexible, foldable, covering layers, at least one of said covering layers comprising solid cushioning material and a casing containing said cushioning material, and being separately tufted and an inflatable, flexible foldable first pneumatic cushioning layer, said pneumatic layer comprising an inflatable casing, said casing providing means to facilitate substantially continuous folding along a plurality of first parallel axes when said pneumatic layer is inflated, said pneumatic layer being captured between said opposing covering layers and a second pneumatic layer captured between said opposing covering layers and arranged to be co-planer with said first pneumatic layer, and said futon provides means to facilitate folding along a second axis perpendicular to said first axes.

2. The futon of claim 1 in which said covering layers have edges bearing closing means for closing said covering layers around said cushioning layer.

3. The futon of claim 1 in which said pneumatic layer has extending edges defining openings, including means for securing said pneumatic layer to at least one of said covering layers, said means extending through said openings.

4. The futon of claim 1 in which said first and second pneumatic layers include means for inflating said pneumatic layers to different degrees of inflation.

5. A flexible, foldable futon, comprising opposing flexible, foldable, covering layers, at least one of said covering layers comprising solid cushioning material and a casing containing said cushioning material, and first and second inflatable, flexible, foldable pneumatic cushioning layers, each said pneumatic layer comprising an inflatable casing, said inflatable casing providing means to facilitate folding along a plurality of parallel axes when said pneumatic layer is inflated, whereby said futon is foldable along a plurality of parallel axes when said pneumatic layer is inflated, said first and second pneumatic layers being captured between said opposing covering layers and arranged to be co-planar, and said futon provides means to facilitate folding along a second axis perpendicular to said first axis, in which said first pneumatic layer includes a first means for inflating said first pneumatic layer, and said second pneumatic layer includes a second means for inflating said second pneumatic layer independently of said first inflating means.

* * * * *